US005458047A

United States Patent [19]

McCormick

[11] Patent Number: 5,458,047

[45] Date of Patent: Oct. 17, 1995

[54] HIGH SPEED PNEUMATIC SERVO ACTUATOR WITH HYDRAULIC DAMPER

[76] Inventor: Joseph F. McCormick, P.O. Box 2490, Holyoke, Mass. 01041

[21] Appl. No.: 206,453

[22] Filed: Mar. 4, 1994

[51] Int. Cl.[6] ..... F15B 13/16; F15B 15/22

[52] U.S. Cl. ..... 91/361; 92/8; 92/12

[58] Field of Search ..... 91/4 R, 361; 92/8, 92/9, 10, 11, 12

[56] References Cited

U.S. PATENT DOCUMENTS

| | | | |
|---|---|---|---|
| 2,821,172 | 1/1958 | Randall | 92/10 X |
| 2,832,200 | 4/1958 | Grout et al. | 92/9 X |
| 2,891,514 | 6/1959 | Moeller | 92/ 9 X |
| 3,017,865 | 1/1962 | Frantz et al. | 92/9 |
| 3,128,673 | 4/1964 | Moore, Jr. | 92/10 X |
| 3,176,801 | 4/1965 | Huff | 92/9 X |
| 3,698,826 | 10/1972 | Henderson | 92/11 X |
| 3,894,477 | 7/1975 | Tomikawa | 92/10 X |
| 4,528,894 | 7/1985 | Crosby | 91/361 X |
| 4,765,225 | 8/1988 | Birchard | 92/9 X |

*Primary Examiner*—John E. Ryznic

*Attorney, Agent, or Firm*—McCormick, Paulding & Huber

[57] ABSTRACT

A hydraulic damper for a high speed actuator is provided to bring the actuator to rest with minimum oscillation around a target position. The hydraulic damper comprises a hydraulic circuit to communicate with the actuator over its entire positional range for the purpose of dampening a sudden stop of the actuator about a target position. The actuator is connected by a cable to a reel, the reel being connected to a shaft movement of the actuator produces rotation of the shaft. The shaft is also connected to a hydraulic motor which pumps hydraulic fluid through a hydraulic damper too, in effect, dampen the movement of the actuator.

21 Claims, 4 Drawing Sheets

HIGH SPEED PNEUMATIC SERVO ACTUATOR WITH HYDRAULIC DAMPER

BACKGROUND OF THE INVENTION

This invention relates to a high speed pneumatic actuator, and more particularly relates to an electrohydraulic/pneumatic method of controlling pneumatic servo actuators for use in control applications such as robotics.

Actuators are roughly divided into three classes: hydraulic, pneumatic, and electromechanical.

Hydraulic actuators are preferably used in applications requiring precise positioning because hydraulics exhibit absolute breaking force properties but tend to be prohibitively expensive—typically costing $20,000 per axis of movement. Furthermore, hydraulic actuators pose leakage and environmental problems making their use either impractical or impossible in certain applications such as food handling.

Electromechanical actuators, such as those using ball gears, have the benefit of extremely precise positioning. A drawback, however, is that the mechanical components driving the actuator have a short life span especially when high speeds are involved.

The present pneumatic servo actuators while offering high speed actuation are very difficult to control with precision, primarily due to the compressibility of air which causes springiness of movement. Robotics using pneumatic actuators tend to be limited to single destination machines such as pick and place devices. The present invention eliminates this problem by providing an incompressible braking medium throughout the actuator's operating range so as to eliminate the springiness inherent in a compressible medium. As a result, a robotics device can be precisely controlled over a potentially infinite range of positions.

Accordingly it is an object of the present invention to provide a high speed pneumatic servo actuator using a novel hydraulic damper that allows accurate positioning of the actuator without the springiness of movement resulting from gas compressibility.

It is also an object of the present invention to provide closed loop electronic control of the actuator from a microprocessor.

Additional objectives and advantages of the present invention will be made apparent in the following description with reference to the accompanying drawings.

SUMMARY OF THE INVENTION

A hydraulic damper used in combination with a pneumatic controller for a high speed actuator, such as a pneumatic cylinder containing a movable piston, is provided to bring the actuator to a stop with minimum oscillation around a target position. The hydraulic damper comprises a hydraulic circuit for containing an incompressible medium to communicate with the actuator over its entire positional range to dampen a sudden stop of the actuator about a desired position.

The hydraulic damper may include monitoring means such as electromechanical transducers for generating dynamic operating information based on operating characteristics of the actuator. Examples of operating characteristics, to name a few, include pressure, position, velocity and acceleration.

Processing means may be employed for receiving the dynamic operating information from the monitoring means and for generating control signals to adjust the position of the actuator in conformance with actuator reference information.

DESCRIPTION OF THE PREFERRED EMBODIMENTS

The present invention resides in a hydraulic damper to be used in combination with a pneumatic controller for high speed pneumatic actuators commonly used in robotics. The actuators typically comprise pneumatic cylinders housing pistons which move placement arms in pick and place robots. A problem with pneumatic cylinders is that the piston within the cylinder tends to oscillate about a target position when suddenly stopped because of the compressibility of air. Hence, precise robotic positioning is an inherent problem with pneumatic actuators. In response to the foregoing problem, the present invention employs a hydraulic damper in combination with a pneumatic controller to bring a high speed pneumatic actuator to rest at a target position with minimum oscillation.

Figure 1:
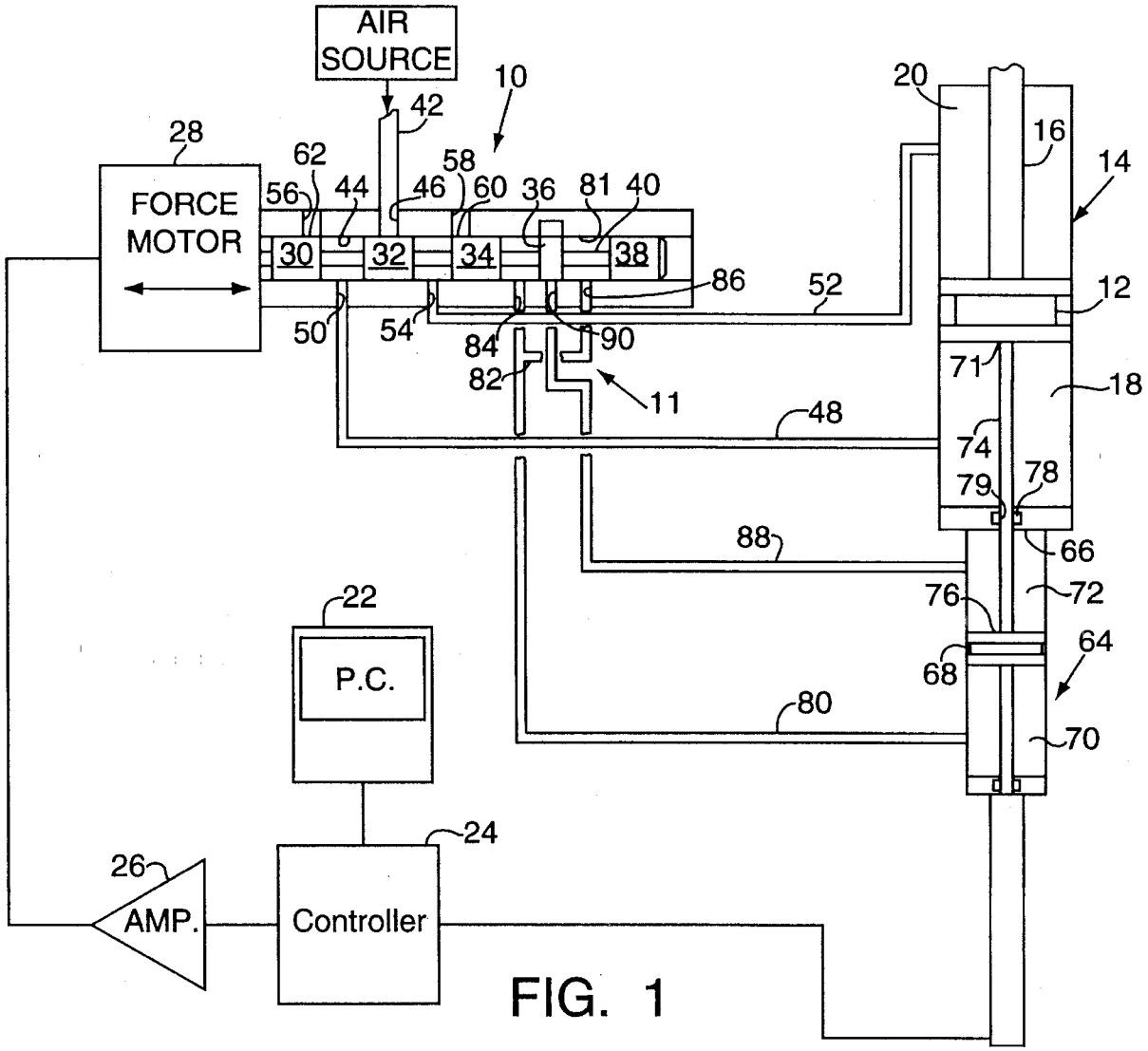
FIG. 1 schematically illustrates one embodiment of a combination hydraulic damper/pneumatic controller to control the position of a high speed pneumatic actuator.

FIG. 1 schematically illustrates a first embodiment of a linear positioning pneumatic actuator controller 10 which incorporates a hydraulic damper 11. The controller 10 controls the positioning movement of the pneumatic actuator, more specifically the position of a pneumatic piston 12 within a pneumatic cylinder 14. The movement of the piston 12, in turn, is transferred to attached main rod 16 to allow the movement of the piston 12 to be communicated externally.

The piston 12 within the pneumatic cylinder 14 divides the pneumatic cylinder 14 into a first chamber 18 and a second chamber 20. The respective volumes of chambers 18 and 20 increase or decrease in inverse relationship with one another depending on the position of the piston 12.

A programmable source such as personal computer 22 can be used to input commands to be processed by a processing means such as electronics controller 24. For example, input commands may include: start commands, stop commands, and start and stop position information for the piston 12 of the pneumatic cylinder 14. The controller 24 is preferably used in conjunction with transducers to receive positional and dynamic information of the piston 12. In response to this piston information, the controller 24 generates command signals to dampen piston movement.

These commands signals processed by the controller 24 are amplified through signal amplifier 26 in order that the command signals are at a sufficient level to sufficiently excite coils that drive a linear force motor 28. The force motor 28 is capable of bi-directional movement so as to move either leftwardly or rightwardly as viewed in FIG. 1 depending on the polarity of the excitation signal.

The force motor 28 bi-directionally moves valves 30, 32,34, 36, and 38 either leftwardly or rightwardly so as to regulate air and move a substantially incompressible liquid to control the position of the pneumatic piston 12. The incompressible liquid aids the controller 24 to significantly dampen the movement of the pneumatic piston 12 when stopped. The force motor 28 transmits its motion to the valves through interconnecting rod 40 which connects the valves to one another. Hence, when the force motor moves either leftwardly or rightwardly, the valves move in unison with the motor and with each other.

Referring now to the operation of the controller 10 shown in FIG. 1, an air intake 42 supplies high pressure air from a source (not shown) to a pneumatic junction 44 of the pneumatic actuator controller 10. The junction 44 diverts air to the pneumatic cylinder 14 depending on the relative positions of the valves within the pneumatic junction. Supply aperture 46 forms the boundary between the air intake 42 and the pneumatic junction 44.

A first pneumatic conduit 48 provides a gas flow path from the pneumatic junction 44 to the first chamber 18 of the pneumatic cylinder 14. Depending on the relative positions of the valves 30, 32, and 34 within the pneumatic junction 44, gas may be blocked from flowing through the first pneumatic control conduit. Similarly, the position of the valves can be adjusted within the pneumatic junction 44 to allow gas to flow either toward or away from the pneumatic cylinder 14 via the first pneumatic conduit 48. First pneumatic aperture 50 forms the boundary between the pneumatic junction 44 of the controller 10 and the first pneumatic conduit 48.

A second pneumatic conduit 52 provides a gas flow path from the pneumatic junction 44 to the second chamber 20 within the pneumatic cylinder 14. Depending on the relative positions of the valves 30, 32, and 34 within the pneumatic junction 44, gas may be blocked from flowing through the second pneumatic conduit. Similarly, the position of the valves can be adjusted to allow gas to flow either toward or away from the pneumatic cylinder 14 via the second pneumatic conduit 52. Second pneumatic aperture 54 forms the boundary between the pneumatic junction 44 of the controller 10 and the second pneumatic conduit 52.

Depending on the relative positions of the valves 30, 32, and 34, a first exhaust port 56 or second exhaust port 58 provides an escape path for a flow of gas returning from the pneumatic cylinder 14.

With respect to the actual positions of the valves 30, 32, and 34 shown in FIG. 1, the valve 32 act as a gas input obstruction which totally blocks the supply aperture 46, thereby preventing the flow of source air from the air intake 42 to the pneumatic junction 44. Because air flow is interrupted, no air can flow through either the first pneumatic conduit 48 or the second pneumatic conduit 52 to move the pneumatic piston 12 within the pneumatic cylinder 14.

The force motor 28 is arbitrarily chosen to be moved rightwardly from the position shown in FIG. 1 in response to a positive excitation voltage from the controller 24. The force motor 28, in turn, moves the valves 30, 32, 34, 36, and 38 rightwardly in direct proportion to its own movement. As the valves move rightwardly, the valve 32 begins to unblock the left portion of the supply aperture 46 to allow pressurized gas to flow from the air intake 42 into the pneumatic junction 44. The pressurized gas then flows past the first pneumatic aperture 50 and through the first pneumatic conduit 48 to the first chamber 18 of the pneumatic cylinder 14.

As a result of the gas flow into the first chamber 18, the pressure within the first chamber increases, thereby forcing the pneumatic piston 12 upward to equalize the pressure between the first chamber 18 and the second chamber 20. As the piston 12 moves upwardly, the pressure within the second chamber 20 increases, thereby forcing return air to flow through the second pneumatic conduit 52 and past the second pneumatic aperture 54 into the pneumatic junction 44 of the controller 10. The valve 34 acting as a pneumatic obstruction has also moved rightwardly so as to partially unblock a second exhaust aperture 60 which forms the boundary between the pneumatic junction 44 and the second exhaust port 58, thereby allowing the return gas to escape.

The gradual opening or blocking of the apertures by the moving valves serves the important purpose of limiting the acceleration of the pneumatic piston 12, thereby preventing damage to the pneumatic cylinder.

Similarly, the force motor 28 can be arbitrarily chosen to be moved leftwardly from the position shown in FIG. 1 in response to a negative excitation voltage from the controller 24. The force motor 28, in turn, moves the valves 30, 32, 34, 36, and 38 leftwardly in direct proportion to its own movement. As the valves move leftwardly, the valve 32 begins to unblock the right portion of the supply aperture 46 to allow gas to flow from the air intake 42 into the pneumatic junction 44. The pressurized gas continues past the second pneumatic aperture 54 and through the second pneumatic conduit 52 to the second chamber 20 of the pneumatic cylinder 14.

As a result of the gas flow into the second chamber 20, the pressure within the second chamber increases, thereby forcing the piston 12 downward to equalize the pressure between the first chamber 18 and the second chamber 20. As the piston 12 moves downwardly, the pressure within the first chamber 18 increases, thereby forcing return air to flow through the first pneumatic conduit 48 back to the pneumatic junction 44 of the controller 10. The valve 30 acting as a pneumatic obstruction has also moved leftwardly so as to partially unblock first exhaust aperture 62 which forms the boundary between the pneumatic junction 44 and the first exhaust port 56. Unblocking the first exhaust aperture 62 allows the return gas flowing through the first pneumatic conduit 48 to escape through the first exhaust port 56.

Because of the compressibility of a gas, stopping the pneumatic piston is typically accompanied by undesired oscillations. In response to this problem, the hydraulic damper 11 is incorporated into the high speed pneumatic actuator controller 10 to aid the electronics controller 24 in dampening the oscillation of the pneumatic piston 12 about a desired stop position. The hydraulic damper 11 partly comprises a hydraulic cylinder 64 which takes advantage of the incompressibility of liquid to substantially eliminate the sponginess of movement of the pneumatic piston 12 over the piston's entire operating range. The function of the hydraulic cylinder 64 within the controller 10 will now be explained in detail.

Longitudinal ends of the pneumatic cylinder 14 and the hydraulic cylinder 64 abut one another at cylinder junction 66. A hydraulic piston 68 of the hydraulic cylinder 64 divides the hydraulic cylinder into a first chamber 70 and a second chamber 72. The motion of the hydraulic piston 68 is slaved to the motion of the pneumatic piston 12 via a slave rod 74 which is attached at one end to the pneumatic piston 12 at 71 and is attached at the other end to the hydraulic piston 68 at 76. The slave rod extends through both the first chamber 18 of the pneumatic cylinder 14 and through the second chamber 72 of the hydraulic cylinder 64. Cylinder junction aperture 79 defined at the cylinder junction 66 permits the slave rod 74 to extend through it from the pneumatic piston 12 to the hydraulic piston 68. Annular seal 78 surrounds the slave rod 74 to prevent gas from leaking from the pneumatic cylinder 14 into the hydraulic cylinder 64 and to prevent liquid from leaking from the hydraulic cylinder 64 into the pneumatic cylinder 14.

Referring to the operation of the hydraulic circuit including hydraulic conduit means, a first hydraulic conduit 80 provides a liquid flow path from a hydraulic junction 81 to the first chamber 70 of the hydraulic cylinder 64. The first hydraulic conduit 80 bifurcates at junction 82 for communicating with the hydraulic junction at two places. The first place which hydraulic conduit 80 communicates with the hydraulic junction 81 is at first hydraulic aperture 84 which forms the boundary between the hydraulic junction 81 and the first hydraulic conduit 80. The second place which the first hydraulic conduit 80 communicates with the hydraulic junction 81 is at second hydraulic aperture 86 which forms the boundary between the hydraulic junction 81and the first hydraulic conduit 80.

As shown in FIG. 1, the first hydraulic conduit 80 communicates on both sides of a hydraulic valve means comprising the valve 36 acting as a central hydraulic obstruction in order to equalize the liquid pressure on both sides of the valve 36.

Depending on the relative positions of the hydraulic valve means, specifically the valves 34, 36, and 38 within the hydraulic junction 81, liquid may be blocked from flowing through the first hydraulic conduit 80. For example, the valve 34 acting as a lateral hydraulic obstruction may shift to the right from the position shown in FIG. 1 so as to block the first hydraulic conduit 80 at 84, and the valve 36 acting as the central hydraulic obstruction may shift to the right to block the first hydraulic conduit at 86. Similarly, the position of the valves can be adjusted to allow liquid to flow either toward or away from the hydraulic cylinder 64 through the first hydraulic conduit 80.

Hydraulic conduit means including a second hydraulic conduit 88 provides a path for liquid to flow from the hydraulic junction 81 to the second chamber 72 of the hydraulic cylinder 64. Depending on the relative positions of the valves 34, 36, and 38 within the hydraulic junction 81, liquid may be blocked from flowing through the second hydraulic conduit 88. For example, FIG. 1 shows the valve 36 completely blocking a third hydraulic aperture 90 which forms the boundary between the hydraulic junction 81 of the controller 10 and the second hydraulic conduit 88. Similarly, the position of the valves can be adjusted to allow liquid to flow either toward or away from the hydraulic cylinder 64 through the second hydraulic conduit 88. Unlike the pneumatic circuit, the hydraulic circuit is a closed-loop circuit with the source of liquid motion originating from the motion of the pneumatic piston 12.

The operation of the hydraulic damper 11 will now be explained. As will be recalled, when the valves move rightwardly, the pneumatic piston 12 moves upwardly in response to increasing air pressure within the first chamber 18 of the pneumatic cylinder 14. The slave rod 74 communicates this upward motion to the hydraulic piston 68 within the hydraulic cylinder 64. As a result of this upward movement of the hydraulic piston 72, liquid pressure builds up within the second chamber 72 of the hydraulic cylinder 64 so as to force liquid out of the hydraulic cylinder and into the second hydraulic conduit 88. At this moment, the valve 36 has moved rightwardly from the position shown in FIG. 1 so as to partially unblock the left portion of the first hydraulic aperture 84. As a result, liquid is permitted to flow from the second hydraulic conduit 88 past the third hydraulic aperture at 90 and into the hydraulic junction 81. The liquid within the hydraulic junction 81 is, in turn, forced to flow into the first hydraulic conduit 80 via the first hydraulic aperture 84 and into the first chamber 70 of the hydraulic cylinder 64, thereby equalizing the pressure on both sides of the hydraulic piston 68.

Since the motion of the hydraulic piston 68 is slaved to that of the pneumatic piston 12 by means of the slave rod 74, any change in speed or motion of the pneumatic piston 12 results in moving the hydraulic piston 68. Moving the hydraulic piston 68 forces liquid through the hydraulic circuit so as to equalize the liquid pressure within both the chambers 70 and 72 of the hydraulic cylinder 64. The inertia resistance of the liquid toward change in motion acts as a counter force or retardation to the motion of the pneumatic piston 12. The incompressibility of the liquid efficiently feeds back this resistance to movement through the counter force to dramatically dampen any sponginess of movement inherent in the sudden movement of pneumatic pistons. As a result, the pneumatic piston can be used with greater precision and control in high speed applications. For example, introducing hydraulic dampening can transform a one destination pick-and-place apparatus into a high speed robot having precise placement control over an potentially infinite range of placement destinations.

Figure 2:
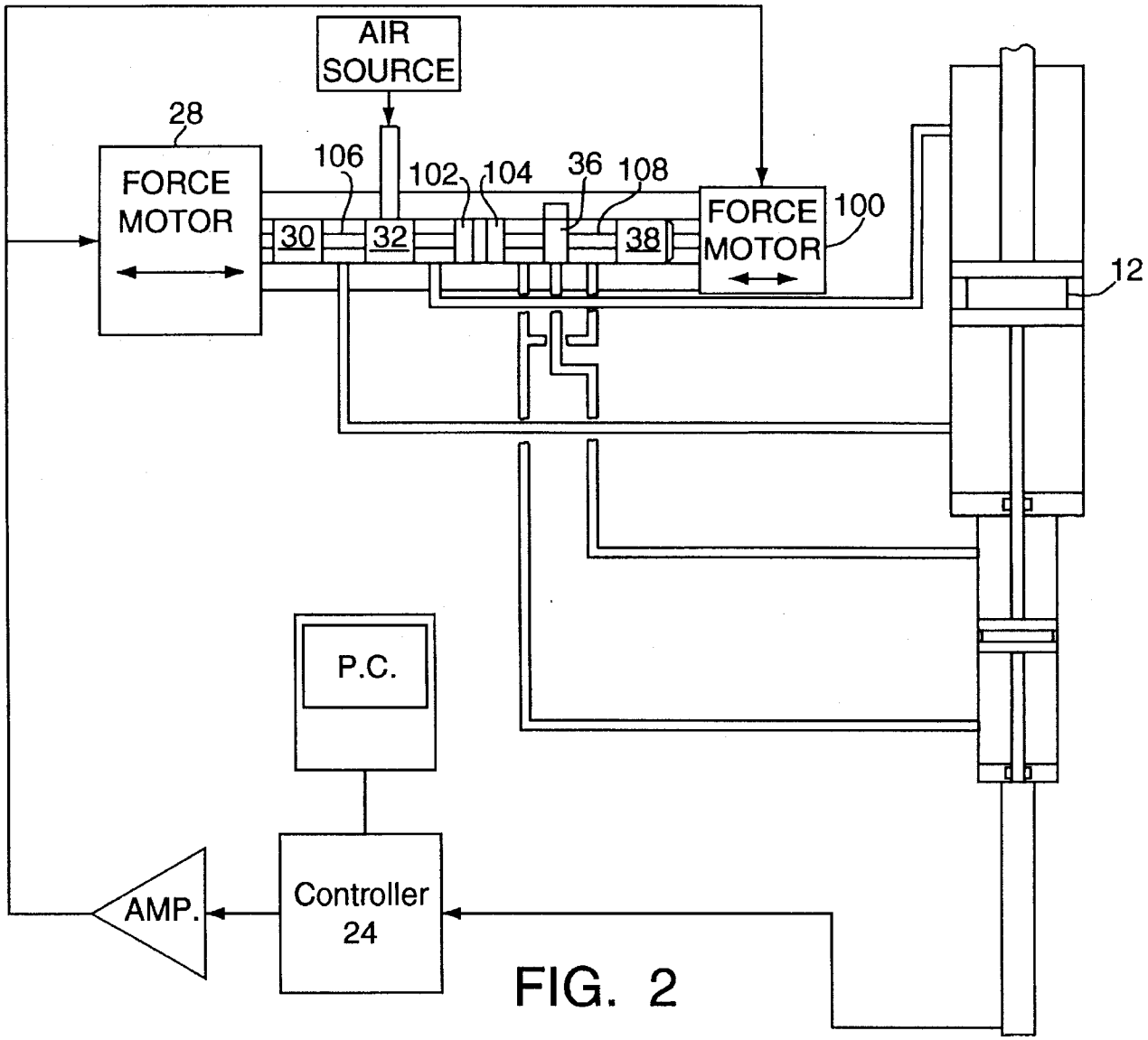
FIG. 2 schematically illustrates a second embodiment of a hydraulic damper used in combination with a high speed pneumatic actuator.

FIG. 2 illustrates a second embodiment of the present invention. Like elements with FIG. 1 are labeled with like reference numerals.

The embodiment of FIG. 2 incorporates a second linear force motor 100 which works independently of the force motor 28. The force motor 28 is dedicated to controlling the position of the pneumatic piston 12, whereas the force motor 100 is dedicated to controlling the position of the hydraulic piston 68.

The valve 34 of FIG. 1 is replaced in FIG. 2 by two independently and bi-directionally moved valves 102 and 104. The valve 102 moves either leftwardly or rightwardly in unison with the valves 30 and 32 via interconnect 106 in response to the force motor 28. Similarly, the valve 104 moves in unison with the valves 36 and 38 via interconnect 108 in response to the force motor 100.

The independently operated force motors 28 and 100 allow the controller 24 to have greater control over the operations of the pneumatic cylinder 14 and the hydraulic cylinder 64.

Figure 3:
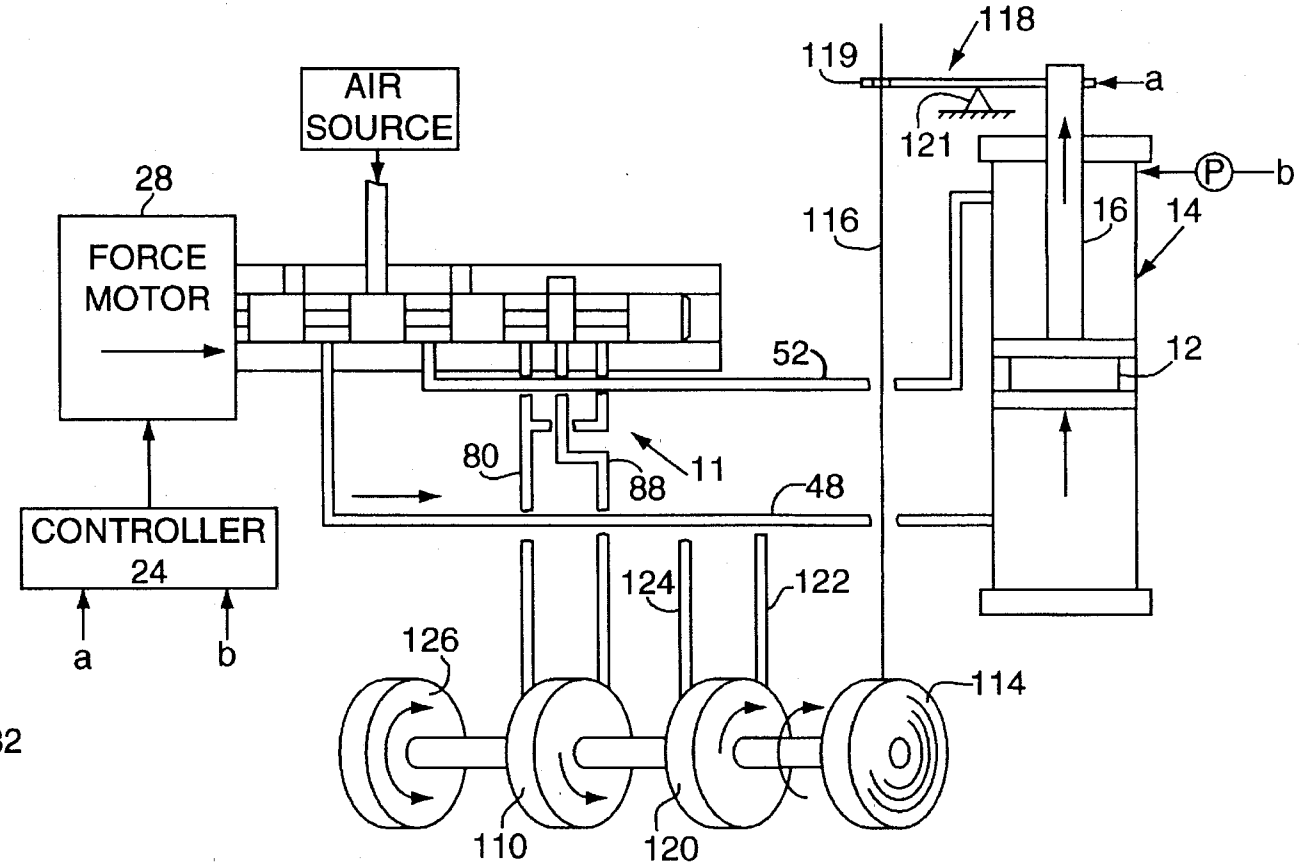
FIG. 3 schematically illustrates a third embodiment of a combination hydraulic damper/pneumatic controller to control the position of a high speed pneumatic actuator.

FIG. 3 illustrates schematically a third embodiment of the present invention with like elements with FIGS. 1 and 2 labeled with like reference numerals.

As can be seen in FIG. 3, the hydraulic damper 11 for dampening the movement of the pneumatic piston 12 is not accomplished by a hydraulic piston. Rather, a hydraulic motor 110 attached to a rotatable shaft 112 replaces the hydraulic cylinder of FIGS. 1 and 2 for generating the desired dampening force.

In this embodiment, the dampening force is transmitted through the shaft 112 to the pneumatic piston 12 by means of a cable 116. A reel 114 for containing the cable is attached to the shaft 112 so as to rotate with it. The cable 116 is attached at one end to the reel 114 and is attached at its other end to the main rod 16 of the pneumatic cylinder 14 via a suitable connecting means 118 such as pulleys or a combination of lever 119 and fulcrum 121. For example, the connecting means may comprise a pair of pulleys to transmit the linear force originating from the movement of the pneumatic piston 12 into a twisting force applied to the shaft 112. The cable 116 is arbitrarily wound around the reel 114 so that a clockwise rotation of the shaft 112 viewed along the right longitudinal end of the shaft in FIG. 3 will cause the cable to become taut as it is wound around the reel 114.

A stiffness reaction torquer 120 is attached to the shaft 112 for rotating the shaft 112 in order to keep the cable 116 taut when the piston is moving in such a direction (upwardly as shown in FIG. 3) so as to create slack in the cable 116. Hence, the torquer 120 keeps the cable constantly taut in order to transmit the motion of the pneumatic piston to the shaft 112 and to simultaneously transmit a dampening force from the hydraulic motor 110 back to the pneumatic piston, regardless of whether the pneumatic piston moves upwardly or downwardly. The cable tightening force generated by the torquer 120 is just strong enough to keep the cable 116 taut but not strong enough to influence the movement of the pneumatic piston 12.

The torquer 120 is pneumatically powered through an air supply port 122 connected rearwardly of the shaft 112 as viewed in FIG. 3, and has an air exhaust port 124 connected frontwardly of the shaft 112. Pressurized air to the torquer 120 transmits this tightening force through the shaft 112 in a direction tending to wind the cable taut around the reel 114.

For example, say the force motor 28 is arbitrarily chosen to be moved rightwardly from the position shown in FIG. 3 in response to a positive excitation voltage from the controller 24. The pneumatic piston 12 will be forced to move upwardly as was explained above with respect to the embodiment of FIG. 1. This upward movement of the pneumatic piston 12 creates slack in the cable 116, thereby permitting the torquer 120 to rotate the shaft 112 for winding the cable 116 until taut. Hence, the upward movement of the pneumatic piston 12 dictates the rotation of the shaft 112.

As the pneumatic piston moves upwardly, the hydraulic motor 110 forces incompressible liquid through the first and second hydraulic control hoses 80 and 88 so that the inertia of the moving liquid creates a counter torque to the shaft 112. The counter torque is transmitted through the cable 116 which dampens the movement of the pneumatic piston 12.

If the pneumatic piston is made to move downwardly so as to unwind the cable 116 from the wheel 114, the unwinding of the cable will rotate the shaft 112 in a counterclockwise direction as seen from the right end of the shaft in FIG. 3. The clockwise twisting force from the torquer is not powerful enough to overcome the counterclockwise rotation to the shaft generated by the downward movement of the pneumatic piston. Hence, the downward movement of the pneumatic piston 12 dictates the rotation of the shaft 112.

As the pneumatic piston moves downwardly, the hydraulic motor 110 forces incompressible liquid through the first and second hydraulic control hoses 80 and 88 so that the inertia of the moving liquid creates a counter torque to the shaft 112. The counter torque is transmitted through the cable 116 which dampens the movement of the pneumatic piston 12.

The shaft can support monitoring means such as electromechanical transducers which create electrical signals corresponding to information such as the position, velocity, internal pressure within the actuator and acceleration of the pneumatic piston 12 within the pneumatic cylinder 14. For example, a position transducer 126 is fixed to the shaft 112 for sending feedback positional information of the pneumatic piston to a processor (not shown).

Although the hydraulic motor 110 shown in FIG. 3 communicates its dampening force to the pneumatic piston through the shaft 112 and the cable 116, other equivalent means of communication may be substituted.

Figure 4:
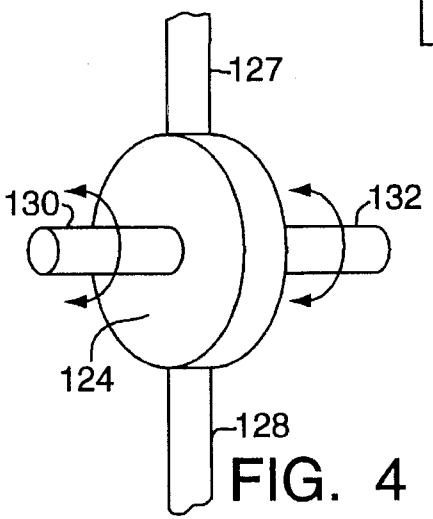
FIG. 4 partially schematically illustrates a fourth embodiment of the present invention employing a rotary actuator.

FIG. 4 is a partial schematic illustrating a fourth embodiment of the present invention employing a rotary actuator 124 which is bi-directional as illustrated by the bi-directional arrows in FIG. 4. The structure of the present embodiment is similar to those of the previous embodiments shown in FIGS. 1–3 except for the way a dampening force is transmitted to the rotary actuator.

The rotary actuator is driven pneumatically by first and second pneumatic conduits 127 and 128, respectively. The inertial dampening of a substantially incompressible liquid is transmitted to the rotary actuator 124 by means of a rotating shaft 130 to dampen the rotational movement of an output shaft 132 of the actuator 124. A rotary .actuator offers an advantage over a linear actuator in that the rotatable shaft 112 can directly dampen the rotational movement of the rotary actuator 124 without the need for additional components. Referring back to FIG. 3, the reel 114, the cable 116, the connecting means 118 are not needed to connect a shaft to a rotary actuator as shown in FIG. 4.

Figure 5:
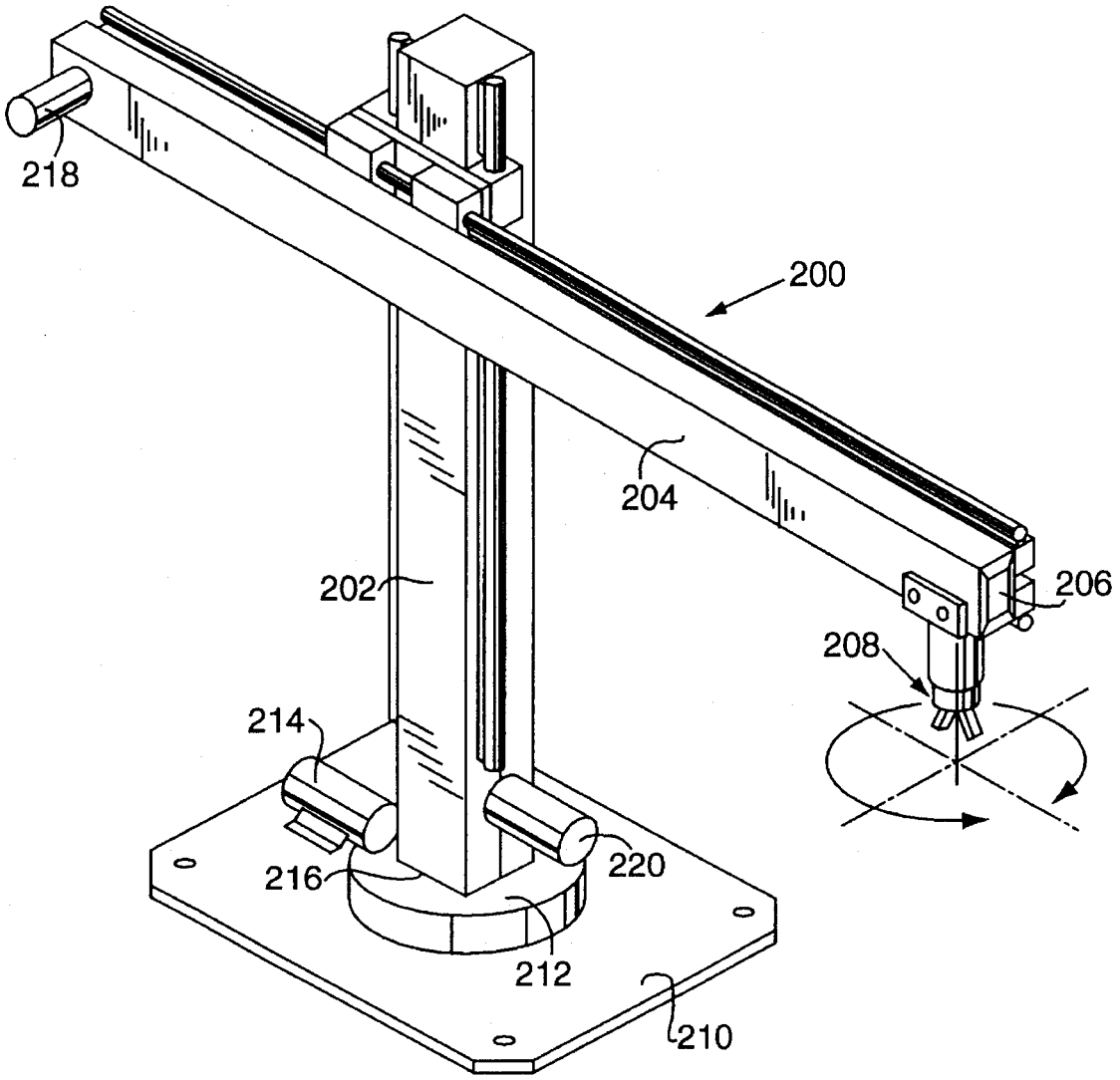
FIG. 5 illustrates an application of the present invention in a robot having three degrees of freedom.

FIG. 5 illustrates a robotics application utilizing the combination hydraulic damper of the present invention. A placement robot 200 comprises a rotatable vertical shaft 202 and a linearly movable horizontal shaft 204. Attached at one end of the horizontal shaft at 206 is a gripper 208 for grabbing objects at a predetermined initial position and releasing them at a predetermined destination position.

Plate 210 supports a rotary actuator 212 which is controlled by a pneumatic controller 214 incorporating a hydraulic damper in accordance with the present invention. One end of the vertical shaft 202 is fixed to the rotary actuator 212 at 216, thereby enabling the rotary actuator to rotate the vertical shaft 202 about its longitudinal axis. The rotating vertical shaft, in turn, moves the horizontal shaft 204 and the gripper 208 circumferentially about the longitudinal axis of the vertical shaft 202.

The horizontal shaft 204 has its own actuator and a pneumatic controller 218 embodying the advantages of the present invention to enable the horizontal shaft and gripper to move quickly and precisely toward and away from the horizontal shaft without the :imprecise sponginess of movement inherent in pneumatic actuators.

Similarly, the vertical shaft 202 has its own actuator and a pneumatic controller 220 to enable the horizontal shaft 204 and gripper 208 to move quickly and precisely up and down the vertical shaft.

The high speed precision introduced by the pneumatic controllers incorporating the novel hydraulic dampening feature allows the robot to pick up and release objects over a potentially infinite number of differentially spaced positions within its range of movement.

The present invention is not limited to the particular embodiments shown and described herein, but that various changes and modifications may be made without departing from the spirit and scope of the present invention. For example, the high speed pneumatic controller need not be limited to purely linear or rotational movement. Complex movements patterns can be generated by incorporating the present invention. In addition, the advantage of the present invention may be applied to the entire range of an actuator's movement from start to stop. Accordingly, the present invention has been described in several preferred embodiments by way of illustration rather than limitation.

I claim:

1. A high speed pneumatic controller for controlling a linear positioning pneumatic actuator having bi-directional positioning movement and for bringing the positioning movement of said actuator to a stop with minimum oscillation around a target position, said controller comprising:

a pneumatic circuit communicating with said pneumatic controller to operate said pneumatic actuator; and a closed-loop hydraulic circuit powered by said actuator to pump a substantially incompressible liquid through said hydraulic circuit so as to create an inertial dampening force to be fed back to said actuator for dampening positioning movement when said actuator positioning movement comes to a stop, said closed-loop hydraulic circuit comprising:

hydraulic conduit means to channel said substantially incompressible liquid through said hydraulic circuit;

a hydraulic damper to pump said incompressible liquid through said hydraulic conduit means, said hydraulic damper including:

a rotatable shaft to rotate in response to a positioning movement of said pneumatic actuator;

a reel attached to said shaft;

a cable having a first end and a second end, the first end of said cable being attached to said reel, and the second end of the cable being attached to said linear positioning actuator, said cable to transmit a linear positioning movement of the actuator to the shaft so as to rotate said shaft;

a hydraulic motor rotatably attached to the shaft for forcing a substantially incompressible liquid through said hydraulic conduit means when said shaft rotates, and for simultaneously feeding back a dampening force created by an inertial movement of said liquid to said actuator via said cable in order to substantially eliminate any sponginess of positioning movement of said actuator when the positioning movement of the actuator is suddenly stopped; and means for keeping the cable taught when a positioning movement of the linear actuator is in a direction which would otherwise slacken the cable.

2. A high speed pneumatic controller according to claim 1, wherein said pneumatic circuit comprises:

pneumatic conduit means to channel a gas originating from a pneumatic pressure source back and forth between said pneumatic controller and said pneumatic actuator in order to operate said actuator.

3. A high speed pneumatic controller according to claim 2, wherein said pneumatic conduit means comprises:

a pneumatic junction to hold a gas;

a first pneumatic conduit having first and second ends;

a second pneumatic conduit having first and second ends, said pneumatic actuator comprising first and second chambers, said first and second chambers being separated by a pneumatic piston, whereby a change of pressure between first and second chambers moves said piston;

said first end of said first pneumatic conduit communicating with said pneumatic junction and said second end of said first pneumatic conduit communicating with said first chamber of said pneumatic actuator;

said first end of said second pneumatic conduit communicating with said pneumatic junction and said second end of said second pneumatic conduit communicating with said second chamber of said pneumatic actuator; and pneumatic valve means movable within said pneumatic junction, said pneumatic valve means for regulating the direction and rate of flow of a gas through said first and second pneumatic conduits.

4. A high speed pneumatic controller according to claim 3, wherein said pneumatic valve means comprises:

a gas input obstruction having bi-directional movement for movably blocking in varying degrees an input gas flow coming from said pneumatic pressure source to said pneumatic junction and for directing the input gas flow to either the first pneumatic junction or the second pneumatic junction;

a first pneumatic obstruction having bi-directional movement for movably blocking in varying degrees a gas flow between said pneumatic junction and said first pneumatic conduit; and a second pneumatic obstruction having bi-directional movement for movably blocking in varying degrees a gas flow between said pneumatic junction and said second pneumatic conduit.

5. A high speed pneumatic controller according to claim 1, wherein said hydraulic conduit means comprises:

a hydraulic junction to hold a substantially incompressible liquid;

a first hydraulic conduit having first and second ends, said first end of said first hydraulic conduit being split into first and second branches for communicating with said hydraulic junction at two locations in order to equalize fluid pressure within said junction, and said second end of said first hydraulic conduit communicating with a first port of said hydraulic damper;

a second hydraulic conduit having first and second ends, said first end of said second hydraulic conduit communicating with said hydraulic junction, and said second end of said second hydraulic conduit communicating with a second port of said hydraulic damper; and hydraulic valve means movable within said hydraulic junction, said hydraulic valve means for regulating the direction and rate of flow of said liquid through said first and second hydraulic conduits.

6. A high speed pneumatic controller according to claim 5, wherein said hydraulic valve means comprises:

a central hydraulic obstruction having bi-directional movement for movably blocking in variable degrees a liquid flow from said hydraulic junction to said second hydraulic conduit via said first end of said second hydraulic conduit;

a first lateral hydraulic obstruction having bi-directional movement for movably blocking in varying degrees a liquid path from said hydraulic junction to said first hydraulic conduit via said first branch of said first hydraulic conduit; and a second lateral hydraulic obstruction for movably blocking in varying degrees a liquid flow path from said hydraulic junction to said first hydraulic conduit via said second branch of said first hydraulic conduit means;

said first and second lateral hydraulic obstructions being respectively placed on opposite sides of said central hydraulic obstruction to equalize liquid pressure on both sides of said central hydraulic obstruction.

7. A high speed pneumatic controller according to claim 5, further including a linear force motor to position said hydraulic valve means and said pneumatic valve means.

8. A high speed pneumatic controller according to claim 7, further including:

monitoring means for generating dynamic operating information based on operating characteristics of an actuator, said operating information comprising: position, velocity, acceleration, and internal pressure within said actuator; and processing means for receiving said dynamic operating information from said monitoring means, and for generating control signals to operate said linear force motor which adjusts the positioning movement of an actuator in conformance with actuator reference information.

9. A high speed pneumatic controller according to claim 5, further including:

a first linear force motor to position said pneumatic valve means; and a second linear force motor to position said hydraulic valve means.

10. A high speed pneumatic controller according to claim 9, further including:

monitoring means for generating dynamic operating information based on operating characteristics of an actuator, said operating information comprising: position, velocity, acceleration, and internal pressure within said actuator; and processing means for receiving said dynamic operating information from said monitoring means, and for generating first control signals to operate said first linear force motor, and for generating second control signals to operate said second linear force motor, said motors adjusting the position of an actuator in conformance with actuator reference information.

11. A high speed pneumatic controller according to claim 1, wherein the means for keeping the cable taught is a stiffness reaction torquer.

12. A high speed pneumatic controller for controlling a rotary positioning pneumatic actuator having bi-directional positioning movement and for bringing the positioning movement of said actuator to a stop with minimum oscillation around a target position, said controller comprising:

a pneumatic circuit communicating with said pneumatic controller to operate said pneumatic actuator; and a closed-loop hydraulic circuit powered by said actuator to pump a substantially incompressible liquid through said hydraulic circuit so as to create an inertial dampening force to be fed back to said actuator for dampening positioning movement when said actuator positioning movement comes to a stop, said closed-loop hydraulic circuit comprising:

hydraulic conduit means to channel said substantially incompressible liquid through said hydraulic circuit;

a hydraulic damper to pump said incompressible liquid through said hydraulic conduit means, said hydraulic damper including:

a rotatable shaft coupled to the rotary actuator to rotate in response to a positioning movement of said rotary pneumatic actuator; and a hydraulic motor coupled to the shaft for forcing a substantially incompressible liquid through said hydraulic conduit means when said shaft rotates, and for simultaneously feeding back a dampening force created by an inertial movement of said liquid to said actuator via said rotatable shaft in order to substantially eliminate any sponginess of positioning movement of said rotary actuator when the positioning movement of the actuator is suddenly stopped.

13. A high speed pneumatic controller according to claim 12, wherein said pneumatic circuit comprises:

pneumatic conduit means to channel a gas originating from a pneumatic pressure source back and forth between said pneumatic controller and said pneumatic actuator in order to operate said actuator.

14. A high speed pneumatic controller according to claim 13, wherein said pneumatic conduit means comprises:

a pneumatic junction to hold a gas;

a first pneumatic conduit having first and second ends;

a second pneumatic conduit having first and second ends, said pneumatic actuator comprising first and second chambers, said first and second chambers being separated by a pneumatic piston, whereby a change of pressure between first and second chambers moves said piston;

said first end of said first pneumatic conduit communicating with said pneumatic junction and said second end of said first pneumatic conduit communicating with said first chamber of said pneumatic actuator;

said first end of said second pneumatic conduit communicating with said pneumatic junction and said second end of said second pneumatic conduit communicating with said second chamber of said pneumatic actuator; and pneumatic valve means movable within said pneumatic junction, said pneumatic valve means for regulating the direction and rate of flow of a gas through said first and second pneumatic conduits.

15. A high speed pneumatic controller according to claim 14, wherein said pneumatic valve means comprises:

a gas input obstruction having bi-directional movement for movably blocking in varying degrees an input gas flow coming from said pneumatic pressure source to said pneumatic junction and for directing the input gas flow to either the first pneumatic junction or the second pneumatic junction;

a first pneumatic obstruction having bi-directional movement for movably blocking in varying degrees a gas flow between said pneumatic junction and said first pneumatic conduit; and a second pneumatic obstruction having bi-directional movement for movably blocking in varying degrees a gas flow between said pneumatic junction and said second pneumatic conduit.

16. A high speed pneumatic controller according to claim 12, wherein said hydraulic conduit means comprises:

a hydraulic junction to hold a substantially incompressible liquid;

a first hydraulic conduit having first and second ends, said first end of said first hydraulic conduit being split into first and second branches for communicating with said hydraulic junction at two locations in order to equalize fluid pressure within said junction, and said second end of said first hydraulic conduit communicating with a first port of said hydraulic damper;

a second hydraulic conduit having first and second ends, said first end of said second hydraulic conduit communicating with said hydraulic junction, and said second end of said second hydraulic conduit communicating with a second port of said hydraulic damper; and hydraulic valve means movable within said hydraulic junction, said hydraulic valve means for regulating the direction and rate of flow of said liquid through said first and second hydraulic conduits.

17. A high speed pneumatic controller according to claim 16, wherein said hydraulic valve means comprises:

a central hydraulic obstruction having bi-directional movement for movably blocking in variable degrees a liquid flow from said hydraulic junction to said second hydraulic conduit via said first end of said second hydraulic conduit;

a first lateral hydraulic obstruction having bi-directional movement for movably blocking in varying degrees a liquid path from said hydraulic junction to said first hydraulic conduit via said first branch of said first hydraulic conduit; and a second lateral hydraulic obstruction for movably blocking in varying degrees a liquid flow path from said hydraulic junction to said first hydraulic conduit via said second branch of said first hydraulic conduit means;

said first and second lateral hydraulic obstructions being respectively placed on opposite sides of said central hydraulic obstruction to equalize liquid pressure on both sides of said central hydraulic obstruction.

18. A high speed pneumatic controller according to claim 12, further including a linear force motor to position said hydraulic valve means and said pneumatic valve means.

19. A high speed pneumatic controller according to claim 18, further including:

monitoring means for generating dynamic operating information based on operating characteristics of an actuator comprising: position, velocity, acceleration, and internal pressure within said actuator; and processing means for receiving said dynamic operating information from said monitoring means, and for generating control signals to operate said linear force motor which adjusts the positioning movement of an actuator in conformance with actuator reference information.

20. A high speed pneumatic controller according to claim 12, further including:

a first linear force motor to position said pneumatic valve means; and a second linear force motor to position said hydraulic valve means.

21. A high speed pneumatic controller according to claim 20, further including:

monitoring means for generating dynamic operating information based on operating characteristics of an actuator comprising: position, velocity, acceleration, and internal pressure within said actuator; and processing means for receiving said dynamic operating information from said monitoring means, and for generating first control signals to operate said first linear force motor, and for generating second control signals to operate said second linear force motor, said motors adjusting the position of an actuator in conformance with actuator reference information.

* * * * *